United States Patent [19]

Nilsson

[11] 4,436,180

[45] Mar. 13, 1984

[54] METHOD AND A DEVICE FOR PIVOTING AN ACCOMMODATION LADDER

[75] Inventor: Per Nilsson, Västra Frölunda, Sweden

[73] Assignee: AB Welin, Gothenburg, Sweden

[21] Appl. No.: 367,802

[22] Filed: Apr. 12, 1982

[30] Foreign Application Priority Data

Apr. 13, 1981 [SE] Sweden ..... 8102342

[51] Int. Cl.[3] ..... B63B 23/04

[52] U.S. Cl. ..... 182/97; 182/86; 114/368

[58] Field of Search ..... 182/97, 98, 142, 141, 182/86; 14/69.5, 71.1, 71.3; 114/366, 368–374; 212/255

[56] References Cited

U.S. PATENT DOCUMENTS

| | | | |
|---|---|---|---|
| 669,179 | 3/1901 | Powers | 212/255 |
| 1,343,094 | 6/1920 | Sims | 14/71.1 |
| 1,364,727 | 1/1921 | Dawson | 114/373 |
| 1,771,372 | 7/1930 | Bournier | 212/255 |
| 1,893,157 | 1/1933 | Burrill | 114/370 |
| 2,703,893 | 3/1955 | Woodruff | 114/370 |
| 2,780,196 | 2/1957 | Jareckie | 114/370 |
| 3,593,355 | 7/1971 | Husband | 114/370 |
| 4,280,628 | 7/1981 | Goss | 212/255 |

FOREIGN PATENT DOCUMENTS

| | | | |
|---|---|---|---|
| 374428 | 6/1932 | United Kingdom | 114/370 |
| 1149957 | 4/1969 | United Kingdom | 182/97 |

*Primary Examiner*—R. P. Machado
*Assistant Examiner*—Alvin Chin-Shue

[57] ABSTRACT

A method and a device for pivoting an accommodation ladder from a stowing position on a ship's deck to an active position outside the ship's side by means of at least one davit (17) and a pulley (21) for the operating wire (22) of the ladder, said pulley being pivotably mounted at the davit. The pulley is pivoted between two positions admitting the centre of gravity of one ladder to pass the vertical line through the pivot axle (14) of the ladder when the ladder by means of the operating wire (22) is pivoted from stowing and active position resp. The pivoting of the pulley (21) is achieved by means of a member (27), e.g. a wire transmitting a pull to the pulley caused by the weight of the ladder during the downward movement thereof.

3 Claims, 3 Drawing Figures

METHOD AND A DEVICE FOR PIVOTING AN ACCOMMODATION LADDER

The present invention refers to a method for pivoting an accommodation ladder or the like from a stowing position on an active ship's deck to a position outside the ship's side and vice versa means of at least one davit and a pulley for the operating wire of the ladder, said pulley being pivotally mounted at the davit and being pivoted between two positions allowing the ladder by means of the operating wire to be pivoted from the stowing position and active position resp. up to a substantially vertical position, in which the center of gravity of the ladder has passed a vertical line through the pivot center of the ladder.

BACKGROUND OF THE INVENTION

Accommodation ladders on ships are usually stowed on deck in a space or chest arranged for this purpose, which means that the accommodation ladder has to be pivoted about 180° from its stowing position to its operating position. It is for economical reasons not customary to arrange a crane on deck for active the accommodation ladder, but instead the operation of the ladder has been made by means of a fixed davit. It is through the Swedish Pat. No. 334,307 known to provide the davit with a centre of gravity balancing block, which by means of a manually operated or motor-driven mechanism is capable of pivoting the block between two positions allowing the center of gravity of the ladder to pass a vertical line through the pivot axle of the ladder, when the ladder is pivoted from a stowing and active position resp.

Movable spindles and devices for pivoting the block are, however, subjected to severe ferrous corrosion and require a frequent service for the prevention of rust and seizure. Besides these details constitute a complication and rise in price of the whole device and an instability factor if the service is not meticulous.

It has a long time been desirable to perform this operation during the swinging-in and out movement of the accommodation ladder without an external additional force and the purpose of the present invention is to provide a simple construction which practically requires no service and which makes the block to swing between the two positions without any external aids.

According to the invention it is proposed that the pivoting of the pulley is achieved by means of a member attached to the ladder and transmitting a pull to the pulley caused by the weight of the ladder during the downward movement thereof.

The invention also refers to a device for pivoting an accommodation ladder and which solves the above mentioned problems by the fact that the pulley is mounted at one arm of a two-armed link, which is pivoted about a horizontal shaft arranged between said arms, that the link is mounted in the davit and pivoted between its end positions by means of at least one member, e.g., a wire, attached to the ladder at the side remote from its pivot axle, the opposite end of which being connected to the other arm of the link.

DESCRIPTION OF AN EMBODIMENT OF THE INVENTION

Figure 1:
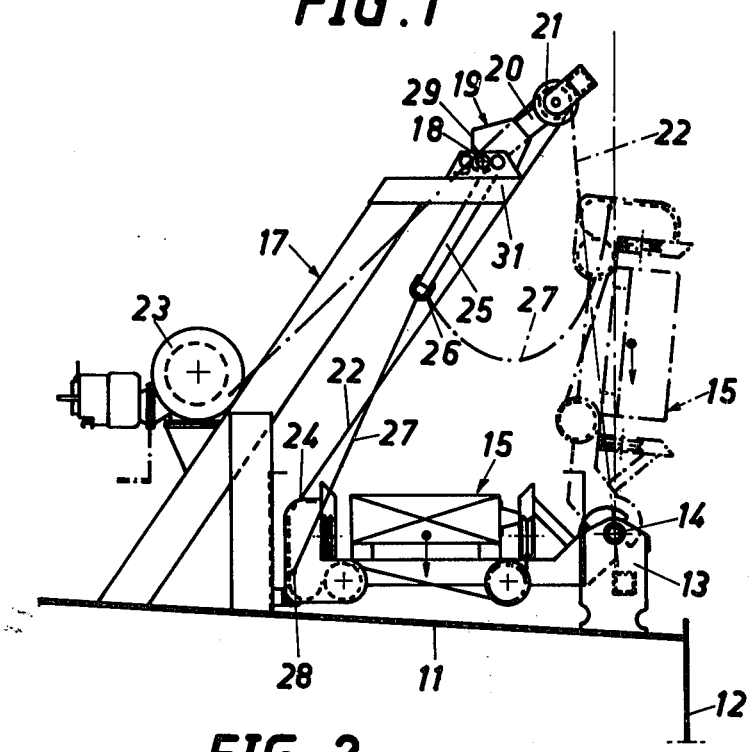
FIG. 1 is a side view of a davit with the device according to the invention arranged on a ship's deck and with the accommodation ladder in stowing position.

The numeral 11 in the drawings denotes a ship's deck, 12 the ship's side and 13 a bearing bracket for an accommodation ladder 15 which is pivotable 180° about a shaft 14. The accommodation ladder is according to FIG. 1 placed in a so-called chest 16 inside the ship's side and beside the chest a fixed davit 17 is arranged, which at its upper portion is provided with a two-armed link 19, which is pivoted about a horizontal shaft 18. At one arm 20 of the link there is mounted a pulley 21 for a wire 22, one end of which being wound up on a winch 23 and the other end 24 being connected to the accommodation ladder 15.

The other arm 25 of the link 19 is at its free end provided with a loop 26, to which a wire 27 with an invariable length is attached. The other end of the wire is attached to the ladder 15 at the attachment point 28.

The link is provided with two stops 29 and 30 cooperating with the bracket 31 of the davit 17. The stops 29 and 30 are arranged in a way so that when the axle of the pulley 21 and the two attachment points 26 and 28 of the wire 27 together are located on a straight line the stops have still not come to contact with the bracket 31. This means that the link 19 can be pivoted somewhat further and the pulley will be located further away from said line by stretching the wire 22.

The device functions in the following way. It is assumed that the ladder is in the position shown in FIG. 1. When the wire 22 is wound up on the winch 23 the link 19 will be pivoted as far as allowed by the stop 30 and the accommodation ladder with its adhering pivotable davits starts to pivot the shaft pivot 14. The ladder can now by its own weight start its downward movement to the operating position shown in FIG. 2 slackening the wire 22. As soon as the fixed wire 27 is stretched, which is done during the final phase of the pivoting movement of the ladder, the link 19 will be pivoted over to its opposite end position so that the pulley 21 takes a correct position, when the accommodation ladder is to pivoted to stowing position.

Figure 2:
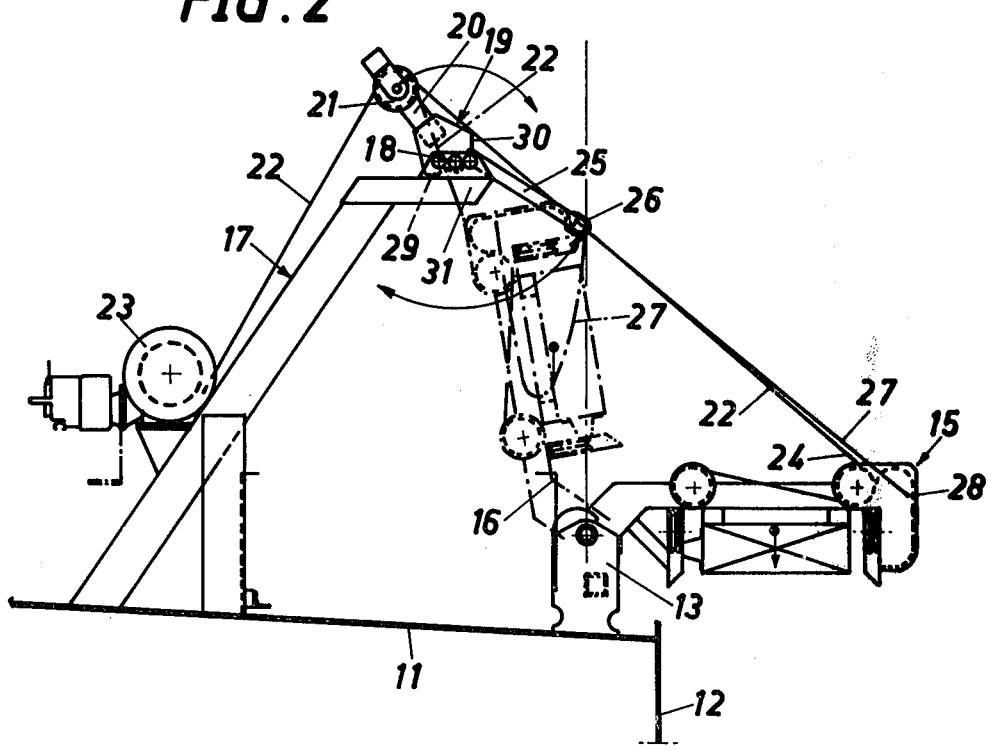
FIG. 2 is a view analogous to FIG. 1 but showing the accommodation ladder in operating position.
Figure 3:
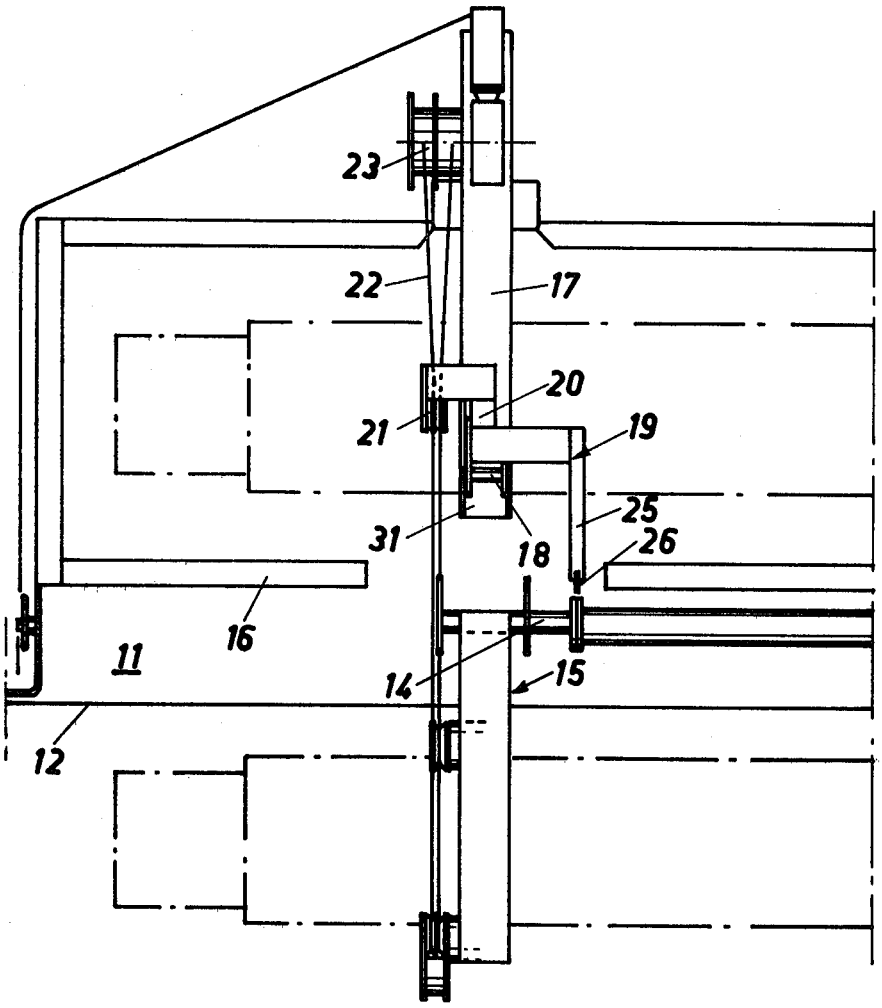
FIG. 3 is a plan view of the davit with the device according to the invention.

This is performed in a corresponding way by winding up the wire 22 on the winch, at which the link 19 is pivoted as far as allowed by the stop 29 and the ladder can be pivoted up to the position shown with dash dotted lines in FIG. 2, in which the center of gravity of the ladder has passed the vertical line through the pivot axle 14 of the ladder. By slackening the wire 22 the ladder will by its own weight be pivoted down to the stowing position shown in FIG. 1. During the final phase of this movement the fixed wire 27 is stretched and the link 19 is pivoted over to its opposite end position.

What I claim is:

1. A method for pivoting an accommodation ladder between a stowing position on a ship's deck and an active position outside the ship's side by means of at least one fixed davit, a pulley mounted on the davit and pivotable between two positions, and an operating wire on said pulley and attached to said ladder, said method comprising the steps of pivoting the ladder by means of the operating wire from one of its stowing and active positions up to a substantially vertical position in which the center of gravity of the ladder has passed a vertical line through the pivot center of the ladder and while the pulley is in one of its positions, allowing the ladder to pivot downwards to the other of its stowing and active positions by slackening the operating wire, and simultaneously pivoting the pulley from its said one position to its other position by means of a pull caused by the weight of the ladder during the downward movement thereof and transmitted to the pulley by a member connected thereto and attached to the ladder.

2. A device for pivoting an accommodation ladder between a stowing position on a ship's deck and an active position outside the ship's side comprising at least one fixed davit, a winch, an operating wire one end of which is wound up on the winch and the other end is attached to the ladder, a two-arm link pivotably mounted on the davit about a horizontal shaft arranged between the said two arms, a pulley for the operating wire mounted on one of said arms of said link and being pivotably movable by said link between two positions, said ladder being pivotable by means of said operating wire from one of its stowing and active positions up to a substantially vertical position in which the center of gravity of the ladder has passed a vertical line through the pivot center of the ladder, and a member having its one end attached to the ladder and its other end connected to the second arm of said link in such a manner that said member causes the link with the pulley to pivot from one of said two positions thereof to the other when the ladder is pivoted downwards further from said substantially vertical position.

3. A device according to claim 2, wherein the link cooperates with a stop located outside the position that the link takes when the axle of the pulley and the two connection points of said member are located on a straight line, so that said pulley is pivotable a further distance away from said line.

* * * * *